US006629828B1

(12) United States Patent
Johansson et al.

(10) Patent No.: US 6,629,828 B1
(45) Date of Patent: Oct. 7, 2003

(54) THERMAL EXPANSION INLET CONNECTION FOR A HIGH PRESSURE PUMP

(75) Inventors: Claes-Göran Johansson, Löddeköpinge (SE); Jörgen Löfstedt, Malmö (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/937,330

(22) PCT Filed: Mar. 23, 2000

(86) PCT No.: PCT/SE00/00570

§ 371 (c)(1),
(2), (4) Date: Dec. 28, 2001

(87) PCT Pub. No.: WO00/57060

PCT Pub. Date: Sep. 28, 2000

(30) Foreign Application Priority Data

Mar. 24, 1999 (SE) ..... 9901080

(51) Int. Cl.[7] ..... F04B 23/04; F04B 1/04; F04B 39/00; F15B 21/04; F16L 17/00

(52) U.S. Cl. ..... 417/521; 417/273; 417/572; 92/1; 285/368

(58) Field of Search ..... 417/273, 521, 417/572; 92/1; 285/368, 412, 125.1, 182

(56) References Cited

U.S. PATENT DOCUMENTS 2,694,583 A * 11/1954 Zitza et al. ..... 285/125.1
3,679,332 A 7/1972 Yohpe
4,184,329 A * 1/1980 Ruesch ..... 60/322
4,214,444 A * 7/1980 Fujioka et al. ..... 60/322
5,203,593 A 4/1993 Brandener
5,566,548 A * 10/1996 Khurana ..... 60/322
5,716,083 A 2/1998 Carr
6,327,854 B1 * 12/2001 Bonny et al. ..... 60/323

FOREIGN PATENT DOCUMENTS

GB 229805 3/1925
SE 512070 1/2000

* cited by examiner

*Primary Examiner*—Charles G. Freay
*Assistant Examiner*—Timothy P. Solak
(74) *Attorney, Agent, or Firm*—Burns, Doane, Swecker & Mathis, L.L.P.

(57) ABSTRACT

The invention relates to an arrangement in a pump block. The pump block includes a plurality of pump valves each connected to a piston in a piston pump. The pump block also includes an inlet pipe which is common to all of the pump valves. The inlet pipe has a connection to each pump valve. One connection between the inlet pipe and the pump block is fixed and includes a flange fixedly screwed in the pump block, the remaining connections are movable in the longitudinal direction of the inlet pipe. The movable connections each include a flange with over-dimensioned boltholes in which a spacer is placed.

5 Claims, 3 Drawing Sheets

THERMAL EXPANSION INLET CONNECTION FOR A HIGH PRESSURE PUMP

FIELD OF THE INVENTION

The present invention relates to an arrangement in a pump block, the pump block including a plurality of pump valves, each connected to a piston in a piston pump, and an inlet pipe common to all of the pump valves, with one connection to each pump valve.

BACKGROUND OF THE INVENTION

The type of pump block with which the arrangement according to the present invention may be employed exists in, for example, a high pressure pump or a homogenizer. A high pressure pump substantially consists of a powerful electric motor with transmission mechanism comprising belt rack, gearbox and crank mechanism housed in a crank housing. The high pressure pump also includes a pump section with the pump block, valves and pistons. The rotary motion from the electric motor is converted by means of the transmission mechanism into the reciprocating motion of the pistons.

A homogenizer is fundamentally a high pressure pump in which the pump block has been supplemented with one or more homogenizer devices or counterpressure devices in which the homogenization proper takes place. A high pressure pump or a homogenizer according to this principle is described in Swedish Patent Application SE 9800896-4.

Homogenization is an industrial process which has long been employed and whose purpose is to finely divide particles in different types of liquids, in order, for example, to stabilise emulsions, to promote flavour and aroma, to improve the colour saturation in paints, etc. A very common field of application is milk homogenization, whose purpose is to shear the largest fat globules occurring in the milk into smaller fat globules and by such means stabilise the fat emulsion, which prevents cream setting. The major proportion of all consumer milk today is homogenized.

Homogenization normally takes place in that, for example, a fat emulsion which may consist of milk is given a high input pressure which drives the emulsion at high speed through a very narrow gap where the fat globules of the fat emulsion are sheared, among other things as a result of the turbulence which occurs on a sudden pressure drop after the homogenization valve. The product which is to be homogenized is pressurized, often up to several hundred bar, by means of the high pressure pump and is forced to pass through a narrow gap in the counter pressure device.

When the product enters the homogenizer or high pressure pump, it passes in through an inlet pipe or duct and is distributed to the different valves in the pump block. In most homogenizers and high pressure pumps today, the inlet duct is drilled in the homogeneous pump block, which entails a high production cost. It also implies that it is not always possible to drill the inlet duct to such large diameters as is desirable. By selecting a large inlet diameter, the speed in the inlet pipe is reduced and thereby the risk of cavitation which may occur as a result of changes in speed arising out of the pulsation of the pump.

Attempts have been made to replace the inlet ducts drilled in the pump block by a separate inlet pipe. But since the product is often heated, very large thermal stresses may occur since the pipe is heated rapidly and the pump block, because of its large mass, is heated much more slowly. As regards homogenization, the product is often at a temperature of 75° C. and the thermal stress which then may occur on start of the homogenizer exceeds the failure point level of the pipe material. High temperatures may also occur in the sterilization of the pipe or tube system before production begins. Naturally, the welds which must of necessity exist in the inlet pipe will crack at considerably lower thermal stress. The larger the homogenizer is, i.e. the greater the number of pump valves in the pump block, the larger will be the thermal stress which occurs between the pump block and the inlet pipe.

Solving this problem using expansion boxes or other expansive tube arrangements is unsuitable, since there is no room for these often bulky apparatuses and they are furthermore not suitable from the point of view of hygiene.

SUMMARY OF THE INVENTION

One object of the present invention is to realise an inlet pipe for a pump block which may be made as a separate part without the thermal stresses causing the pipe to crack.

A further object of the present invention is, by employing the arrangement according to the invention, to realise a considerably more economical inlet to the pump block which affords the possibility of freely selecting the diameter of the inlet.

These and other objects have been attained according to the present invention in that the arrangement of the type described by way of introduction has been given the characterizing feature that one of the connections between the pump block and the inlet pipe is fixed and that the other connections are movable in the longitudinal direction of the inlet pipe.

Preferred embodiments of the present invention have further been given the characterizing features as set forth in the appended subclaims

BRIEF DESCRIPTION OF THE DRAWINGS

One preferred embodiment of the present invention will now be described in greater detail hereinbelow, with particular reference to the accompanying Drawings, in which.

DETAILED DESCRIPTION OF THE INVENTION

Figure 1:
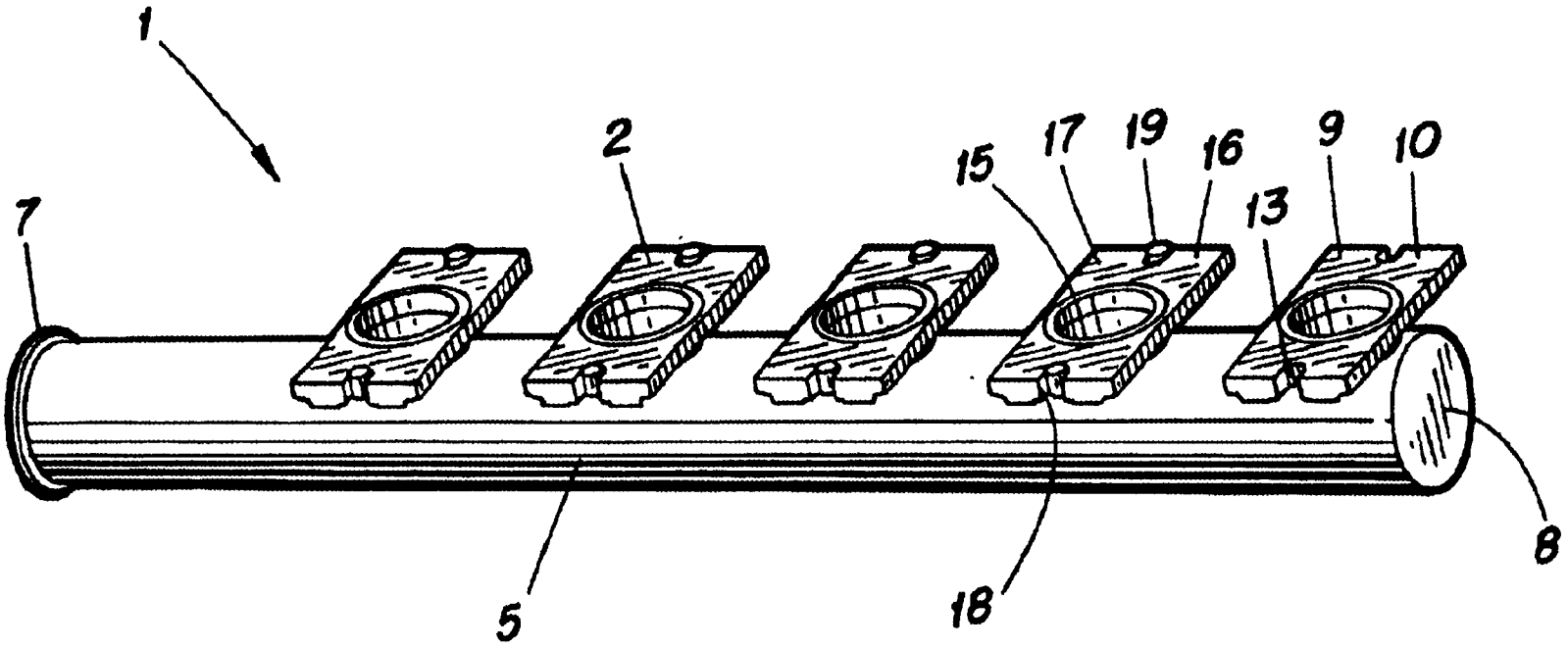
FIG. 1 shows a part of the arrangement according to the present invention.

FIG. 1 shows a part of the arrangement according to the present invention, more precisely an inlet pipe 1 with a number of connections 2 intended to be connected to different pump valves 3 which are enclosed in a pump block 4. The inlet pipe 1 may consist of a standard stainless steel pipe 5 of a diameter which is selected in view of the capacity of the homogenizer 6 or high pressure pump with which the arrangement according to the invention is employed. The inlet pipe 1 constituting as it does a separate part, different inlet pipes 1 of different diameters may be selected for one and the same pump block 4.

In its one end 7, the inlet pipe 1 is open and is there connected to a conduit (not shown) which leads in product to the homogenizer 6 or the high pressure pump. The inlet pipe 1 is closed at its other end 8.

In FIG. 1, the inlet pipe 1 has five connections 2. The number may vary depending on the capacity of the homogenizer 6 or high pressure pump. Of the connections 2, one connection 9 is fixed. In the preferred embodiment, this connection 9 is placed at that end 8 of the inlet pipe 1 which is closed. Alternatively, the fixed connection 9 may be any of the other connections, but it is most practical if the fixed connection 9 is placed at one of the ends 7 or 8 of the inlet pipe.

The fixed connection 9 has a flange 10 which is fixedly welded on a collar 11 around an aperture 12 in the pipe 5. The flange 10 has at least two holes 13 for screw or bolt union. The boltholes 13 are of normal size in relation to the screws or bolts 14 which are employed. In the flange 10, there is disposed an o-ring or gasket 15 which seals the connection 9 when it is screwed in place in the pump block 4.

Figure 2:
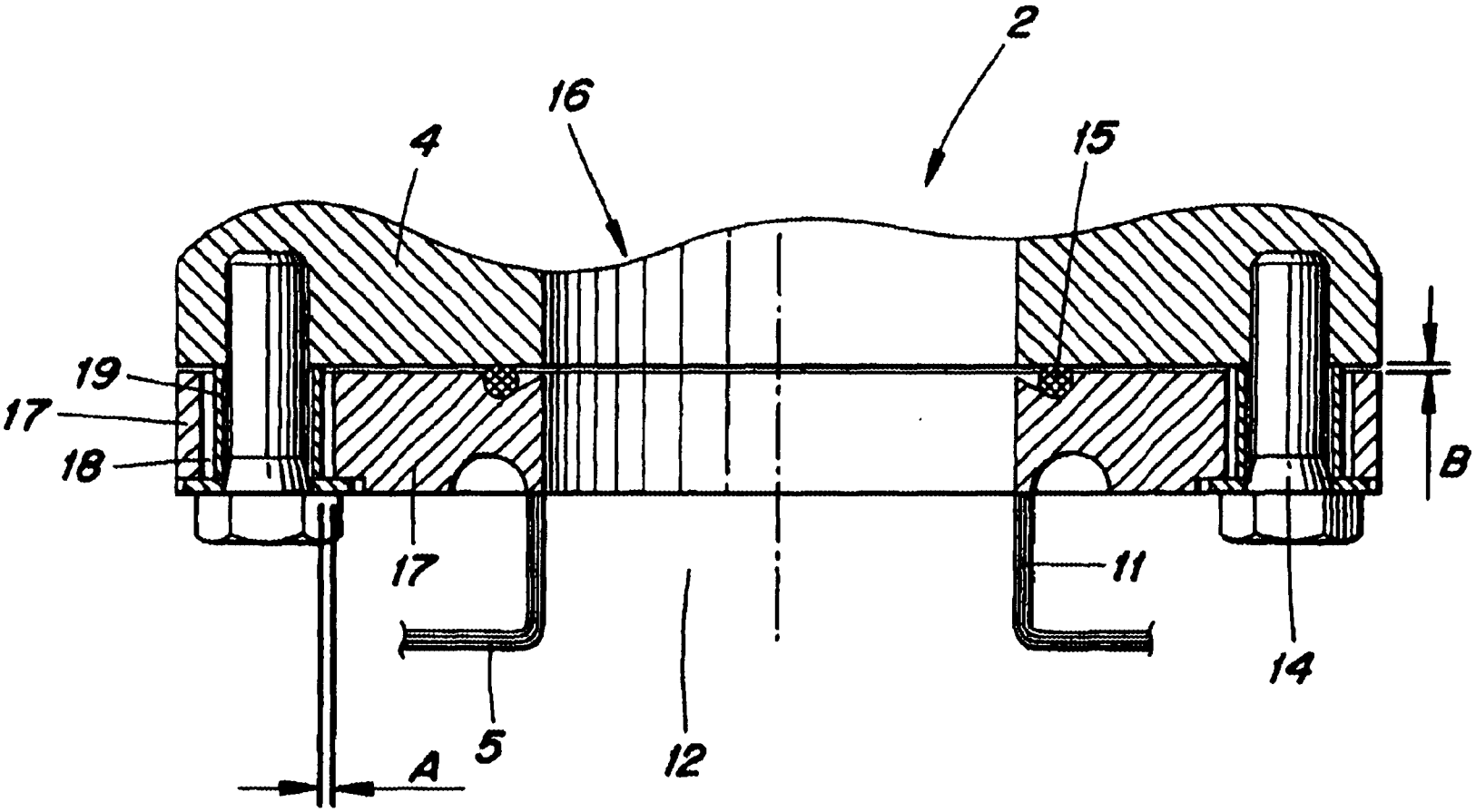
FIG. 2 shows, partly in section, a detail of the arrangement according to the invention.

The remaining connections 16 are movable in the longitudinal direction of the pipe 5. A movable connection 16 is shown in detail in FIG. 2. The movable connection 16 has a flange 17 which is fixedly welded on a collar 11 around an aperture 12 in the pipe 5 in a manner corresponding to the fixed connection 9. The flange 17 has at least two holes 18 for screw or bolt union. The boltholes 18 are over-dimensioned in relation to the screws or bolts 14 which are employed.

A spacer 19 is placed in each of the over-dimensioned boltholes 18. The spacers 19 are of a length which makes them project up above the flange 17 on that side of the flange 17 which is turned to face towards the pump block 4. The spacers 19 have an inner diameter which constitutes a standard sized bolthole for the screws or bolts 14 which are employed. There is a clearance A between the outer diameter of the spacer and the over-dimensioned bolthole 18. The movable connection 16 also has an o-ring or gasket 15 which seals the connection 16 when it is screwed in place in the pump block 4. On full tightening, when the flange 17 is screwed in place in the pump block 4, the o-ring 15 is compressed 20 per cent of its possible compression capability. A compression of 20 per cent is that which is required for an o-ring 15 to seal reliably.

The movable connection 16 is screwed in place in the pump block 4. The length of the spacers 19 is adapted such that, when the screws or bolts 14 are fully tightened, the o-ring seals sufficiently against the pump block 4 and a clearance B occurs between the flange 17 and the pump block 4.

Stainless steel material, of which the inlet pipe is preferably manufactured as regards employment for homogenizers 6 within the dairy industry, has a thermal expansion of 1.65 mm per meter at 100° C. By adapting the over-dimensioned boltholes 18, a clearance A will be obtained which can absorb the expected thermal expansion. The over-dimensioned boltholes 18 can be made with the same clearance A for all movable connections 16. Alternatively, the clearance A may be adapted to the distance from the fixed connection 9, so that a larger clearance A will be obtained the further the movable connection 16 is located from the fixed connection 9. As a result of the clearance B between the flanges 17 and the pump block, the inlet pipe 1 may move unimpeded in relation to the pump block 4.

At that end 7 of the inlet pipe 1 which is connected to incoming product, the inlet pipe 1 is suitably secured in a sliding anchorage or sliding clamp (not shown). The sliding anchorage makes for movement in the longitudinal direction of the pipe 5 and holds it still in the radial direction.

Figure 3:
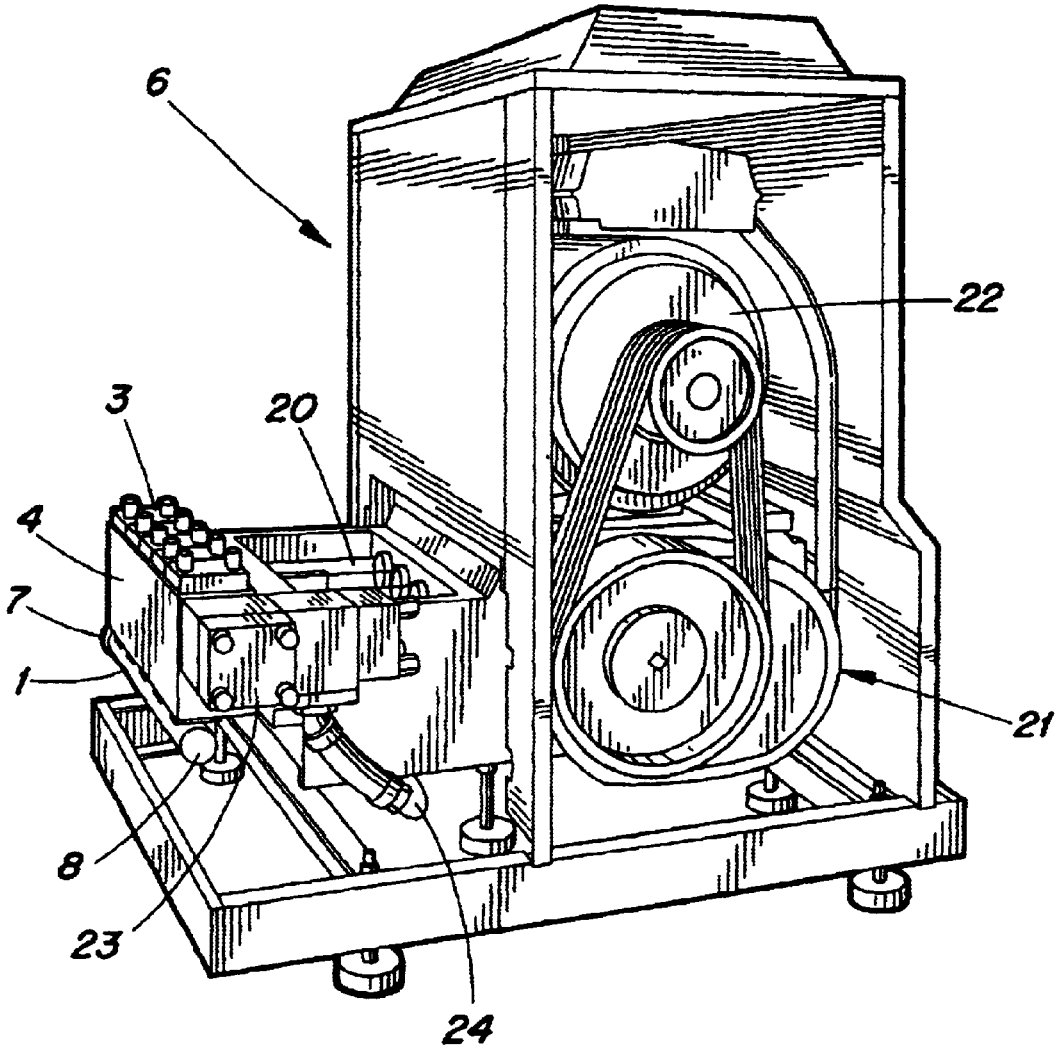
FIG. 3 shows a homogenizer in which the arrangement according to the present invention may be employed.

FIG. 3 shows the arrangement according to the present invention employed in a homogenizer 6. The product arrives at the homogenizer 6 in a conduit which is not shown in the Figure. The conduit is connected to the inlet pipe 1 in its open end 7. The inlet pipe 1 is secured in the pump block 4 by means of one fixed 9 connection and the remaining movable 16 connections 2. The number of connections 2 corresponds to the number of pump valves 3 in the pump block 4. The pump valves 3 are each connected to a piston 20 in a piston pump 21. The piston pump 21 converts the rotary motion from an electric motor 22 into a reciprocating motion. The homogenizer 6 also displays a homogenization device 23 or a counterpressure device.

When the product enters the pump block 4 with its pump valves 3, the product is pressurized by the piston pump 21. The product (which is often pressurized to several hundred bar) is forced at high speed to pass a narrow gap in the homogenization device 23. The product may consist of an emulsion which is to be stabilized. In the event the product is milk, this consists of a fat emulsion with fat globules of different sizes. In the narrow gap of the homogenization device, the fat globules are sheared into smaller globules and a stable emulsion is obtained in which cream setting is prevented. The product departs from the homogenizer 6 through the outlet pipe 24.

As will have been apparent from the foregoing description, the present invention realises an arrangement which constitutes an inlet pipe to a pump block, the pump block being capable of compensating for the thermal stresses which occur in different temperatures in the inlet pipe and in the pump block. The arrangement according to the present invention makes for the use of separate inlet pipes to a pump block without the risk of the pipes cracking because of the large thermal stresses which occur. The present invention also makes for the free selection of the diameter of the inlet pipe, which may reduce the risk of cavitation in the pipe because of the pulsation of the pump.

What is claimed is:

1. An arrangement in a pump block, the pump block including a plurality of pump valves and an inlet pipe common to all of the pump valves, with one connection to each pump valve, wherein a connection between the pump block and the inlet pipe is fixed and that the other connections are movable in the longitudinal direction of the inlet pipe.

2. The arrangement as claimed in claim 1, wherein the fixed connection includes a flange, fixedly connected to the pump block; and that the movable connections each include a flange with over-dimensioned boltholes in which a spacer is placed.

3. The arrangement as claimed in claim 2, wherein the spacer has a diameter smaller than a diameter of the over-dimensioned boltholes such that there is a clearance between the outer diameter of the spacers and the diameter of the over-dimensioned boltholes when the spacer is placed within the over-dimensioned bolthole.

4. The arrangement as claimed in claim 2, wherein the spacers have a length such that the length of the spacers allows a clearance between the flange and the pump block.

5. The arrangement as claimed in claim 4, wherein the clearances permit the movement which occurs because of the thermal stress which may occur between the inlet pipe and the pump block.

* * * * *